United States Patent [19]

Jevakohoff

[11] 4,185,669

[45] Jan. 29, 1980

[54] METHOD AND APPARATUS FOR FILLING A RECEPTACLE WITH POWDER

[75] Inventor: Igor Jevakohoff, Montrouge, France

[73] Assignee: Alfa-Laval S.A., Bougival, France

[21] Appl. No.: 869,700

[22] Filed: Jan. 16, 1978

[30] Foreign Application Priority Data

Jan. 20, 1977 [FR] France ..... 77 01609

[51] Int. Cl.[2] ..... B65B 1/12; B65B 1/26

[52] U.S. Cl. ..... 141/59; 141/73; 141/263; 141/286

[58] Field of Search ..... 141/4,5,7, 8, 10, 11, 141/12, 47, 49, 59, 71, 80, 73, 264, 275–278, 281, 286, 301, 314–317, 324, 374; 222/286, 413

[56] References Cited

U.S. PATENT DOCUMENTS

| | | | |
|---|---|---|---|
| 2,142,990 | 1/1939 | Belcher | 141/59 X |
| 2,981,298 | 4/1961 | Vogt | 141/263 X |
| 2,985,201 | 5/1961 | Baker | 141/12 |
| 3,195,786 | 7/1965 | Vogt | 141/7 X |
| 3,421,554 | 1/1969 | Carter | 141/7 |
| 3,586,066 | 6/1971 | Brown | 141/5 |

*Primary Examiner*—Frederick R. Schmidt
*Attorney, Agent, or Firm*—Cyrus S. Hapgood

[57] ABSTRACT

A filter has one side located in the receptacle during filling thereof with powder. A suction source is connected to the other side of the filter, and means are provided for maintaining said one side of the filter in contact with the upper surface of the powder in the receptacle through said filling thereof, whereby air is sucked from the powder filling the receptacle while preventing powder from being sucked into the suction source.

8 Claims, 7 Drawing Figures

Figure 1:
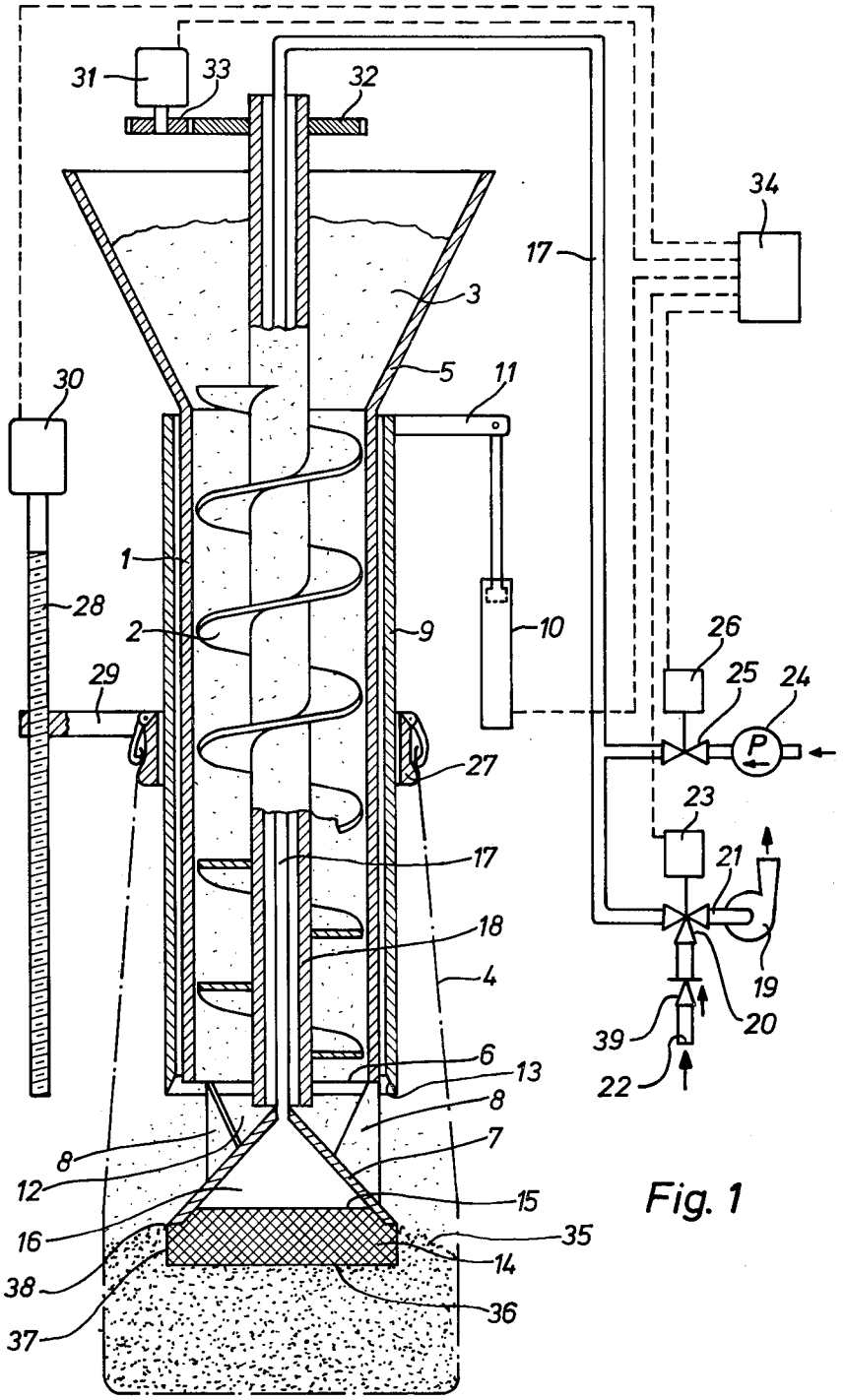
Figure 6:
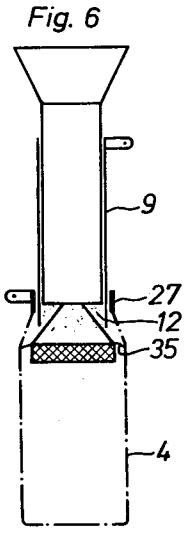
Figure 5:
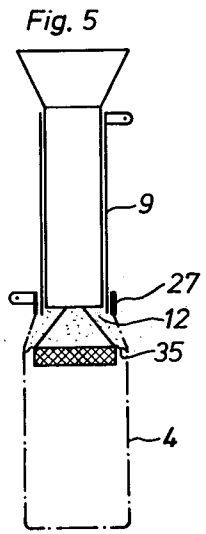
Figure 4:
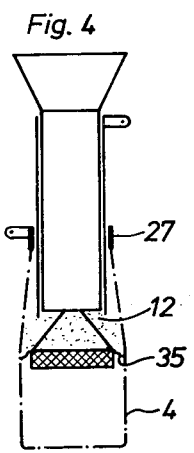

9
27
12
35
4

9
27
12
35
4

27
12
35
4

9
12
4

27
9
4
12
14 t
T1
T2
T3
P
P0
P1
t1
t2

METHOD AND APPARATUS FOR FILLING A RECEPTACLE WITH POWDER

The invention relates to a method of removing a gaseous medium, which accompanies a powder when the powder is filled into a receptacle, by means of a suction source which is connected to one side of a filter, the other side of which is located in the receptacle and which prevents the powder from being sucked to the suction source.

The invention also relates to an arrangement for carrying the said method through.

When a powder is filled into a receptacle, e.g. a bag, ambient gaseous medium, e.g. air, easily mixes with the powder, such that the powder in the filled receptacle will be mixed with a considerable quantity of air.

In the case where the powder is transported to the receptacle with the aid of a flow of air, this air will of course also contribute to an intermixing of air with the powder which has been filled into the receptacle.

The intermixing of air with the powder in the receptacle partly brings the inconvenience that the receptacle gets an unnecessarily large volume and partly the inconvenience that, in the case the receptacle is constituted by a bag, the bag becomes unstable and difficult to transport, e.g. on a belt conveyor.

A method and an arrangement of the kind introductorily set forth to remove a gaseous medium from a powder being filled into a receptacle are known through e.g. the U.S. Pat. No. 2,922,443 which shows an arrangement where a receptacle in the form of a bag is filled with a powder by a spout which is located in the upper part of the bag. The spout is provided with openings for sucking away of air which accompanies the powder which is discharged through the spout.

In the known arrangement it can, however, not be prevented that air mixes with the powder, when the powder moves from the spout to the surface of the mass of powder which already has been fed into the bag and settled in it.

The object of the present invention is to improve the method and arrangement introductorily set forth so, that the gaseous medium more effectively will be removed from the powder in the bag.

This object is achieved through the method according to the invention thereby that one during the filling of the receptacle brings about a relative movement between the filter and the receptacle such that the filter permanently will be located at the surface of powder which already has been filled into the receptacle.

The same object is achieved through the arrangement according to the invention thereby that the feed means is arranged to feed powder to the receptacle such, and that the filter and receptacle are arranged to move relative each other such, that the filter during the filling of the receptacle permanently will be located at the surface of powder which already has been filled into the receptacle.

By the filter during the filling of the receptacle permanently being located at the surface of powder which already has been filled into and settled in the bag, the gaseous medium which mixes with the powder during the last part of its movement down to the surface of the powder, which already has settled in the receptacle, can also be removed.

The contents of gaseous medium in the powder can be further decreased if one according to a further development of the invention during the filling of the receptacle from time to time, e.g. periodically, breaks the communication of the said one side of the filter with the suction source and connects the said one side to ambient atmosphere.

When the said one side of the filter is connected to the ambient atmosphere, a small quantity of gaseous medium will flow from the ambient atmosphere backwards through the filter and flush the side of the filter, which faces the powder, free from powder particles which have stuck in the filter and prevent sucking away of gaseous medium from the powder. Though gaseous medium by this will enter the powder, the subsequent sucking out of gaseous medium from the powder will become more effective, so that the final result will be a decreased contents of gaseous medium in the powder in the receptacle.

An embodiment of an arrangement according to the invention is described below in connection with the attached drawing, in which FIG. 1 shows an arrangement to fill a powder into a bag which arrangement shows a filter for sucking gaseous medium out of the powder, FIGS. 2–6 show different phases during the filling of the bag, and FIG. 7 in the form of a diagram shows how the pressure p, which acts on the suction side of the filter during the filling of the bag, varies with the time t.

With reference to FIG. 1 the numeral 1 designates a tube which is arranged stationarily. A screw 2 is rotatably journalled in the tube 1 for feeding a powder 3 to a bag 4. The powder 3 is supplied to the tube 1 via a hopper 5 which is located at the upper end of the tube 1. A conical body 7 is fastened to the lower end 6 of the tube 1 by arms 8. The tube 1 is surrounded by a sleeve 9 which is displaceable along the tube 1 by a piston-cylinder arrangement 10 which acts on the sleeve 9 via an arm 11. The outlet 12 of the tube 1 is closeable and openable by the sleeve 9. When the outlet 12 shall be closed the sleeve 9 is moved downwards such that its lower end 13 abuts on the body 7. When the outlet 12 is opened, the sleeve 9 is moved up to the position which is shown in FIG. 1.

The body 7 is on its under side provided with a filter 14. One side 15 of the filter confines together with the body 7 a chamber 16 which communicates with a conduit 17 which extends through the shaft 18, which is hollow, of the screw 2.

The conduit 17 is connected to a suction source, e.g. a centrifugal fan 19, via a three-way valve 20. The fan 19 is connected to the valve 20 through a conduit 21, in which a sub-pressure, generated by the fan 19, is prevalent. The valve 20 is also connected to an inlet 22 for ambient air. The valve 20 is controlable by a control means 23 which can control the valve 20 such that the chamber 16 via the conduit 17 is connected to the sub-pressure conduit 21 or to the air inlet 22.

The conduit 17 is furthermore connected to a pressure-air source 24 via a valve 25 which is controlable by a control means 26. The control means 26 can control the valve 25 such that the chamber 16 via the conduit 17 is connected to the pressure-air source 24. A non-return valve 39 is arranged in the conduit between the valve 20 and the inlet 22. The valve 39 prevents pressure-air from escaping through the inlet 22 when the valve 25 is opened.

The bag 4 is at its opening attachable to a bag holder 27 which is vertically displaceably arranged outside the sleeve 9. The holder 27 is displaced by a screw 28, which acts in a threaded portion of an arm 29 of the holder 27. The screw 28 is driveable by a motor 30.

The screw 2 for feeding the powder is driveable by a motor 31 via the shaft 18 of the screw and gear wheels 32 and 33.

The motors 30 and 31, the piston-cylinder arrangement 10 and the control means 23 and 26 are controlable by a central control unit 34.

When a bag 4 is to be filled, the following procedure takes place:

The feed screw 2 stands still, the bag holder 27 is in its lower position and the sleeve 9 closes the outlet 12. The bag is attached to the holder 27. The holder 27 is then raised to its upper position, see FIG. 2, such that the filter 14 will come adjacent the bottom of the bag. The point of time is now $T_1$, see FIG. 7, the inlet 22 communicating with the chamber 16 such that the pressure in the chamber 16 is equal to the atmospheric pressure $P_o$.

Figure 3:
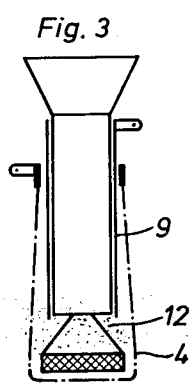
Figure 2:
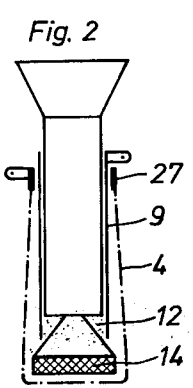

After that the outlet 12 is opened by the sleeve 9 being moved to its upper position, see FIG. 3. The feed screw 2 is brought to rotate so that powder is fed out through the outlet 12. The control means 23 is activated to control the valve 20 so that the chamber 16 alternately will communicate with the inlet 22 or the sub-pressure conduit 21, the pressure in the chamber 16 alternating between the atmospheric pressure $p_o$ and a sub-pressure $p_1$, see FIG. 7. The space of time $t_1$ can e.g. be 0.2–0.3 seconds and the space of time $t_2$ 0.5 seconds. Simultaneously the bag holder 27 is brought to move downwards, see FIG. 4, the rotational speed of the feed screw 2 and the lowering velocity of the bag being controlled such by the control unit 34, that the filter 14 permanently will be located on substantially the same level as the surface 35 of the powder which has settled in the bag. During the space of time $t_2$, which e.g. could be 0.5 seconds, the bag can descend e.g. 10 cm. When the bag holder 27 has reached its lower position, see FIG. 5, the feed screw 2 is stopped and the outlet 12 is closed by the sleeve 9, see FIG. 6. The valve 20 is set such—at the point of time $T_2$—that the chamber 16 again only communicates with the inlet 22.

At the point of time $T_3$ the pressure-air source 24 is shortly connected to the chamber 16 for flushing the filter 14 clean before the filling of the next bag commences. This flushing can take place before a filled bag has been taken away from the bag holder (FIG. 6) or prior to the filling of a new bag.

When the filled bag has been removed from the bag holder 27, a new bag is attached to the bag holder, after which the bag holder is raised and the described filling procedure can be repeated.

The filter 14 is e.g. constituted by a porous body, which is formed and arranged so that it shows a substantially plane side 36 which faces the powder which has settled in the bag. Furthermore, the filter 14 shows a substantially cylindrical side 37 which faces the side of the bag 4. The surface 35 of the powder which has settled in the bag, will here extend from the joint 38 between the side 37 and the conical body 7 to the side of the bag 4.

Figure 7:
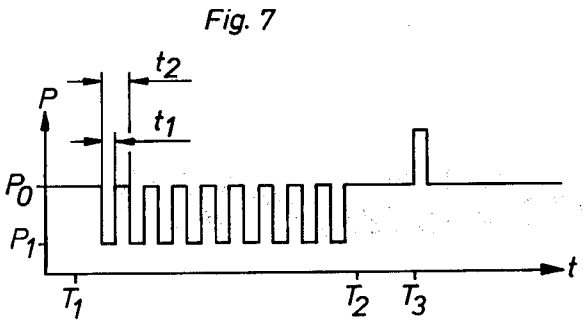

When the chamber 16 from time to time, e.g. periodically, see FIG. 7, during the filling of the bag is connected to the ambient atmosphere via the valve 20 and the inlet 22, air will flow from the conduit 17 and the chamber 16 backwards through the filter, which air will flush the sides 36 and 37 free from powder, the ability of the arrangement to accomplish a compact filling of the powder in the bag thereby being improved.

Within the scope of the invention also such an embodiment falls, where the bag holder is stationary and the filter and the filling arrangement is raised during the filling.

I claim:

1. In combination with a receptacle, apparatus for filling the receptacle with powder while removing a gaseous medium from the receptacle, the apparatus comprising means for feeding powder into the receptacle to fill the same, a filter having one side located in the receptacle, a suction source connected to the other side of the filter, and means for maintaining said one side of the filter in contact with the upper surface of the powder in the receptacle throughout said filling thereof, whereby gaseous medium is sucked from the powder filling the receptacle while preventing powder from being sucked to said suction source, said feeding means including a vertical tube having at its lower end an outlet located in the receptacle, the feeding means also including a helical element in the tube, the apparatus comprising also means mounting the filter below said tube outlet with said other side of the filter facing the tube outlet.

2. The apparatus of claim 1 in which said maintaining means include means for moving one of said receptacle and filter relative to the other at a rate the same as the rate at which the powder level increases in the receptacle.

3. The apparatus of claim 1, comprising also means for intermittently disconnecting said other side of the filter from the suction source and connecting said other side to atmosphere.

4. The apparatus of claim 1, in which the filter is stationary, said maintaining means including means for lowering the receptacle during filling thereof.

5. The apparatus of claim 1, in which said mounting means are secured to the tube and include an upwardly tapering member through which said other side of the filter communicates with the suction source, and arms connecting the tapering member to the tube and forming lateral passages for discharging powder from said tube outlet into the receptacle.

6. The apparatus of claim 1, comprising also means operable after filling of the receptacle to momentarily connect said other side of the filter to a source of super-atmospheric pressure.

7. In combination with a receptacle, apparatus for filling the receptacle with powder while removing a gaseous medium from the receptacle, the apparatus comprising means for feeding powder into the receptacle to fill the same, a filter having one side located in the receptacle, a suction source connected to the other side of the filter, means for maintaining said one side of the filter in contact with the upper surface of the powder in the receptacle throughout said filling thereof, whereby gaseous medium is sucked from the powder filling the receptacle while preventing powder from being sucked to said suction source, said feeding means including a vertical tube having at its lower end an outlet located in the receptacle, the feeding means also including a helical element in the tube, the apparatus comprising also means mounting the filter below said tube outlet with said other side of the filter facing the tube outlet, the apparatus comprising also a sleeve surrounding the tube and movable therealong, the sleeve having an upper position permitting discharge of powder from the tube into the receptacle and also having a lower position where the sleeve coacts with said mounting means to cut off said discharge by blocking the outlet from said tube, and means for moving said sleeve between its upper and lower positions.

8. In combination with a receptacle, apparatus for filling the receptacle with powder while removing a gaseous medium from the receptacle, the apparatus comprising means for feeding powder into the receptacle to fill the same, a filter having one side located in the receptacle, a suction source connected to the other side of the filter, means for maintaining said one side of the filter in contact with the upper surface of the powder in the receptacle throughout said filling thereof, whereby gaseous medium is sucked from the powder filling the receptacle while preventing powder from being sucked to said suction source, said feeding means including a vertical tube having at its lower end an outlet located in the receptacle, the feeding means also including a helical element in the tube, the apparatus comprising also means mounting the filter below said tube outlet with said other side of the filter facing the tube outlet, said mounting means being secured to the tube and including an upwardly tapering member through which said other side of the filter communicates with the suction source, and arms connecting the tapering member to the tube and forming lateral passages for discharging powder from said tube outlet into the receptacle, the apparatus comprising also a sleeve surrounding the tube and movable therealong between an upper position where said lateral passages are open and a lower position for blocking said passages, and means for moving said sleeve between its upper and lower position.

* * * * *